US007872463B2

(12) United States Patent
Jongsma

(10) Patent No.: US 7,872,463 B2
(45) Date of Patent: Jan. 18, 2011

(54) CURRENT BALANCE ARRANGEMENT

(75) Inventor: Jakob Jongsma, Graz (AT)

(73) Assignee: Austriamicrosystems AG, Unterpremstaetten (DE)

( * ) Notice: Subject to any disclaimer, the term of this patent is extended or adjusted under 35 U.S.C. 154(b) by 521 days.

(21) Appl. No.: 11/579,023

(22) PCT Filed: Apr. 15, 2005

(86) PCT No.: PCT/EP2005/004038

§ 371 (c)(1),
(2), (4) Date: Jan. 19, 2007

(87) PCT Pub. No.: WO2005/109144

PCT Pub. Date: Nov. 17, 2005

(65) Prior Publication Data

US 2008/0018320 A1 Jan. 24, 2008

(30) Foreign Application Priority Data

Apr. 30, 2004 (DE) ..... 10 2004 021 232

(51) Int. Cl.
*G05F 1/46* (2006.01)
*G05F 1/613* (2006.01)

(52) U.S. Cl. ..... 323/315

(58) Field of Classification Search ..... 323/315, 323/317; 327/484, 490, 538, 539, 540, 541, 327/542, 543
See application file for complete search history.

(56) References Cited

U.S. PATENT DOCUMENTS 4,325,019 A 4/1982 Tezuka (Continued)

FOREIGN PATENT DOCUMENTS

EP 0 596 653 10/1993

(Continued)

OTHER PUBLICATIONS

English translation of the International Preliminary Examination Report for PCT/EP2005/004038.

(Continued)

*Primary Examiner*—Gary L Laxton
*Assistant Examiner*—Nusrat J Quddus
(74) *Attorney, Agent, or Firm*—Fish & Richardson P.C.

(57) ABSTRACT

A current mirror arrangement comprising two transistors (11, 12) which are of different conductivity types and are each suitable for outputting a bias current (PBIAS, NBIAS) is specified. A controlled current source (13, 13') is connected between the two transistors (11, 12) and forms the output of a current mirror (18, 13'). The proposed principle ensures that the output bias signals (PBIAS, NBIAS) match one another in a highly precise manner. The proposed current mirror arrangement may preferably be integrated using CMOS circuit technology.

18 Claims, 2 Drawing Sheets

U.S. PATENT DOCUMENTS

| | | | | |
|---|---|---|---|---|
| 5,034,626 | A | 7/1991 | Pirez et al. | |
| 5,341,087 | A | 8/1994 | Van Leeuwen | |
| 5,543,745 | A * | 8/1996 | Notani | 327/538 |
| 5,642,037 | A * | 6/1997 | Malherbe | 323/315 |
| 5,680,038 | A | 10/1997 | Fiedler | |
| 5,694,073 | A | 12/1997 | Coots et al. | |
| 6,075,405 | A * | 6/2000 | Nishino et al. | 327/538 |
| 6,232,831 | B1 | 5/2001 | Lennous et al. | |
| 7,057,445 | B2 * | 6/2006 | Hayakawa | 327/541 |
| 2003/0122626 | A1 | 7/2003 | Desortiaux | |
| 2004/0056708 | A1 * | 3/2004 | Bedarida et al. | 327/538 |
| 2007/0290740 | A1 | 12/2007 | Jongsma | |
| 2008/0200134 | A1 | 8/2008 | Jongsma et al. | |
| 2009/0066498 | A1 | 3/2009 | Jongsma et al. | |
| 2009/0072958 | A1 | 3/2009 | Hammerschmidt et al. | |

FOREIGN PATENT DOCUMENTS

| | | |
|---|---|---|
| EP | 0 747 800 | 12/1996 |

OTHER PUBLICATIONS

U. Tietze et al "Halbleiter-Schaltungstechnik" 10th Edition, 1993 62-63.

* cited by examiner

CURRENT BALANCE ARRANGEMENT

The present invention relates to a current mirror arrangement.

Current mirrors are known as basic circuits comprising transistors and are described, for example, in U. Tietze, Ch. Schenk: "Halbleiter-Schaltungstechnik" [Semiconductor circuit technology], 10th edition 1993, pages 62 to 63.

Current mirrors can be employed using different circuit technologies or integration technologies, for example using MOS (Metal Oxide Semiconductor) circuit technology.

FIG. 1 shows an exemplary known current mirror having two transistors 2, 3 which are connected to a reference potential connection 1. The transistors 2, 3 of the current mirror are each of the n conductivity type and their control connections are directly connected to one another. The input-side transistor 2 of the current mirror has a controlled path which is connected, by way of a first connection, to the gate connection of the transistor 2 and, by way of a further connection, to the reference potential connection 1. That connection of the controlled path of the transistor 2 which is connected to the gate connection of the transistor 2 is also connected to a supply potential connection 5 via a current source 4.

The transistor 3 of FIG. 1 also has a controlled path which is connected, on the one hand, to the reference potential connection 1 and, on the other hand, to a connection of a further transistor 6. The further transistor 6 is connected, by way of a further connection of its controlled path, to the supply potential connection 5 and is of the p conductivity type. The control connection of the transistor 6 is connected to that connection of its controlled path which is connected to the transistor 3.

The circuit shown in FIG. 1 is used to generate two bias signals, namely, on the one hand, a bias signal NBIAS for n-MOS components and, on the other hand, a bias signal PBIAS for p-MOS components. The bias signal NBIAS can be tapped off from the control connections of the n-channel transistors 2, 3 at an output connection 7. A further output connection 8 which is connected to the control connection of the transistor 6 is used as an output for tapping off the PBIAS signal.

FIG. 2 shows a development of the circuit of FIG. 1 which largely corresponds to the latter in terms of the components used and their method of operation but has been supplemented with a cascode stage 9, 10. The cascode stage 9, 10 comprises two transistors, each of which is connected in the current paths between the current source 4 and the transistor 2 and between the diode 6 and the transistor 3. In this case, the transistors 9, 10 of the cascode stage, the transistor 9 of which is connected as a diode, themselves again together form a current mirror.

In contrast to the circuit of FIG. 1, in the current mirror arrangement of FIG. 2 having a cascode, the signals NBIAS and PBIAS match one another to an improved extent. Nevertheless, exact matching of the bias signals for components of the opposite, that is to say complementary, conductivity type is not ensured in the circuit shown in FIG. 2 either. Rather, the bias signals may also differ remarkably from one another in the circuit of FIG. 2.

However, it is desirable in many applications for the NBIAS and PBIAS signals to match one another exactly in order, for example, to operate transistors of the complementary conductivity type at respective matching operating points and/or to provide circuits having a high degree of symmetry and good matching.

It is an object of the present invention to specify a current mirror arrangement which makes it possible to output two bias currents which match one another in a very precise manner and are suitable for driving integrated components of different conductivity types.

According to the invention, the object is achieved by means of a current mirror arrangement having:

- a first transistor which is of a first conductivity type and is designed to output a first current,
- a second transistor which is of a second conductivity type and is designed to output a second current,
- a controlled current source which is connected between the first transistor and the second transistor and forms the output of a current mirror.

It corresponds to the proposed principle to provide two transistors which are of different conductivity types and are each used to output a current which is suitable as a bias signal. In this case, the first and second transistors are driven in such a manner that they themselves are not the respective output transistor of a current mirror. Rather, the invention provides for the output transistor of a current mirror to be in the form of a controlled current source which is connected between the first and second transistors.

Owing to the connection of the proposed current mirror arrangement, it is possible to generate, at the first and second transistors, currents which match one another exactly and make it possible to respectively drive complementary components in a highly precise manner. In this case, with an additional advantage, the circuit complexity is low in comparison with a conventional current mirror arrangement for providing complementary bias signals. As a result, the proposed principle can be integrated using a relatively small amount of chip area and thus in a cost-effective manner.

The controlled current source which forms the output of the current mirror that drives the first and second transistors is preferably in the form of a so-called floating current source, that is to say is designed to operate with a floating potential.

The first transistor, the controlled current source and the second transistor are preferably arranged in a common current path. In this case, the controlled current source which is arranged in the center between the two transistors and itself has a floating potential ensures that the currents through the first and second transistors are identical and thus that the two bias currents output from the current mirror arrangement match to an even further improved extent.

The two conductivity types of the transistors are preferably a p conductivity type and an n conductivity type. This means that the first transistor is preferably a p-channel transistor and the second transistor is an n-channel transistor which is complementary to the latter.

The first and second transistors are preferably each connected as a diode.

In one advantageous development, the first and second currents are each tapped off at the load connection of the first and second transistors which is connected to the controlled current source.

It is also preferred for the control connection of the respective transistor to be respectively connected to this tapping node in order to form a diode.

The common current path which comprises the series circuit comprising the first transistor, the controlled current source and the second transistor is preferably connected between a supply potential connection and a reference potential connection.

The controlled current source itself is likewise preferably in the form of a transistor, namely a current source transistor whose controlled path forms a series circuit with the controlled paths of the first and second transistors.

The controlled current source preferably forms the current mirror with a transistor which is connected as a diode, it also being preferred for the transistor which is connected as a diode to be arranged in a further current path which is supplied by an input-side current source. In this case, the current source in the further current path is used as a reference current source.

For reasons of symmetry, it is also preferred for the further current path to comprise a further diode which is connected between the input-side transistor of the current mirror and the reference potential connection or supply potential connection.

Instead of the further diode in the further current path, a further transistor which forms a feedback current mirror together with the second transistor may be provided in an alternative embodiment, the second transistor being connected as a diode. The two current mirrors of this developed current mirror arrangement together form a so-called Wilson current mirror.

The current mirror arrangement is preferably produced using integrated circuitry.

In particular, the current mirror arrangement is preferably integrated using unipolar circuit technology, for example a metal isolator semiconductor structure.

The current mirror arrangement is preferably constructed using complementary MOS circuit technology.

The proposed current mirror arrangement alternatively also functions in the complementary circuit variant; this means that all of the MOS transistors of the n-channel conductivity type are replaced with p-channel components and vice versa.

The invention will be explained in more detail below with reference to a plurality of exemplary embodiments and in connection with the figures, in which.

Figure 1:
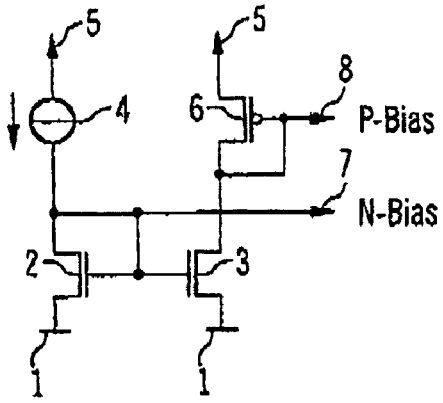
FIG 1 Prior art
FIG. 1 shows a current mirror arrangement according to the prior art.
Figure 2:
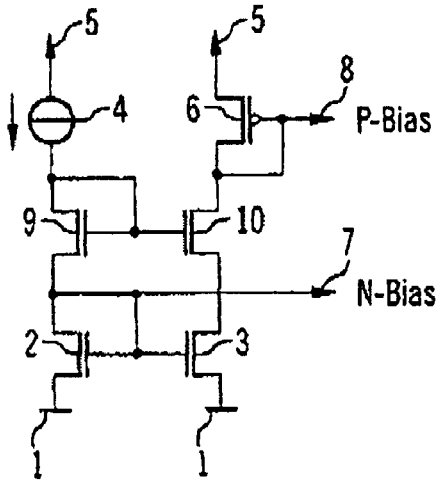
FIG 2 Prior art
FIG. 2 shows a current mirror arrangement according to the prior art having a cascode stage, FIG. 3 uses a circuit diagram to show the basic principle of the proposed current mirror arrangement, FIG. 4 uses a circuit diagram to show a development of the circuit of FIG. 3.

FIGS. 1 and 2 have already been explained in the introduction to the description. Therefore, the description thereof shall not be repeated again at this juncture.

Figure 3:
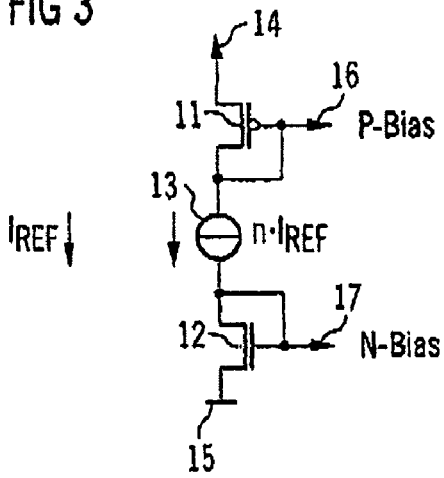

FIG. 3 shows a current mirror arrangement according to the proposed principle having a first transistor 11, which is of a p conductivity type, and having a second transistor 12, which is of an n conductivity type. The first and second transistors 11, 12 each have a control connection and a controlled path. A current source 13 is connected between a respective connection of the controlled paths of the transistors 11, 12. The free connection of the controlled path of the transistor 11 is connected to a supply potential connection 14 and the free connection of the controlled path of the second transistor 12 is connected to a reference potential connection 15. Those connections of the controlled paths of the transistors 11, 12 which are connected to the current source 13 are connected to the respective control connection of the associated transistor 11, 12 in order to form a diode and simultaneously form outputs 16, 17 of the current mirror arrangement. The first output 16 is designed to output a first current PBIAS, while the second output 17 is designed to output a second current NBIAS which is complementary to the first. The first and second currents are used as complementary BIAS signals. As shown in FIG. 1, the current source 13 is in the form of a floating current source, that is to say has a floating potential.

In addition to the current path 11, 13, 12, provision is made of a further current path which is designed to have a reference current $I_{REF}$ flow through it, A current mirror (not explicitly depicted in FIG. 3) is provided for the purpose of coupling these two current paths, which is indicated by virtue of the fact that the n-tuple reference current IEF of the first current path flows through the controlled current source 13. The letter n represents the mirror ratio of the current mirror in this case.

The connection shown in FIG. 3 ensures that the currents in the p-channel transistor 11 and in the n-channel transistor 12 are identical and the complementary bias signals PBIAS, NBIAS which are provided by the transistors and can be tapped off at the outputs 16, 17 are thus also exactly identical. In this case, the proposed circuit has a small amount of component complexity and can be integrated using a small amount of chip area and thus in a cost-effective manner.

Figure 4:
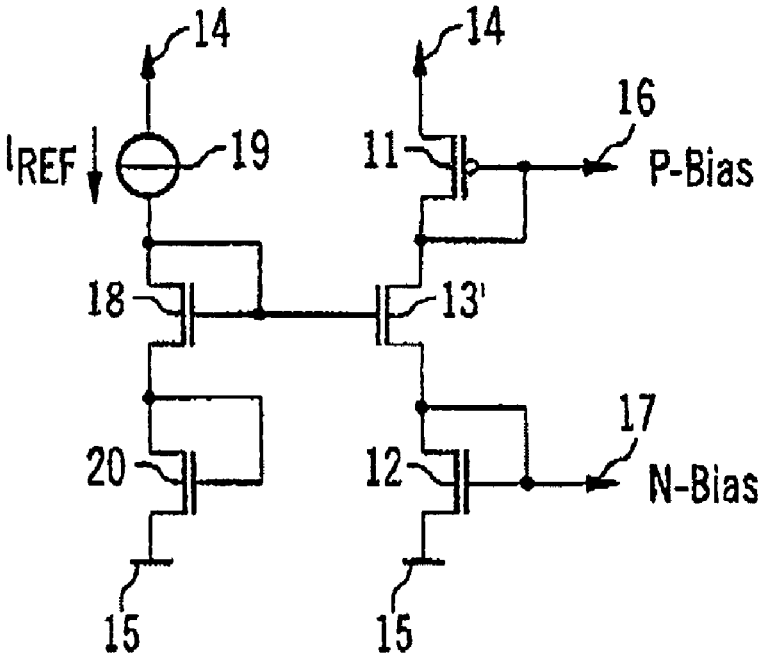

FIG. 4 shows a development of the circuit of FIG. 3 for generating identical n-MOS and p-MOS currents using a current mirror arrangement. The circuit of FIG. 4 largely corresponds to that of FIG. 3 in terms of the components used, their advantageous interconnection and their method of operation and, in this respect, is not repeated again at this juncture.

In FIG. 4, the controlled current source 13 which is operated in a floating manner is in the form of a transistor 13' which forms the current mirror 18, 13' with an input transistor 18. The input transistor 18 is connected as a diode. Like the transistor 13' which operates as a current source, the transistor 18 is of the n-channel type. In order to provide the reference current $I_{REF}$, provision is made of a current source 19 which connects a supply potential connection 14 to a connection of the controlled path of the diode transistor 18 which is also connected to its gate connection. A further transistor diode 20 which is likewise of the n conductivity type connects the transistor 18 to the reference potential connection 1*s*. The reference current source 19, the transistor 18 and the diode 20 thus together form a series circuit.

It can be seen that, starting from a current mirror arrangement having a cascode stage as shown in FIG. 2, only slight modifications and no additional components whatsoever are needed to nevertheless advantageously generate bias currents which match one another exactly and are suitable for operating complementary components in accordance with the circuit of FIG. 4.

Figure 5:
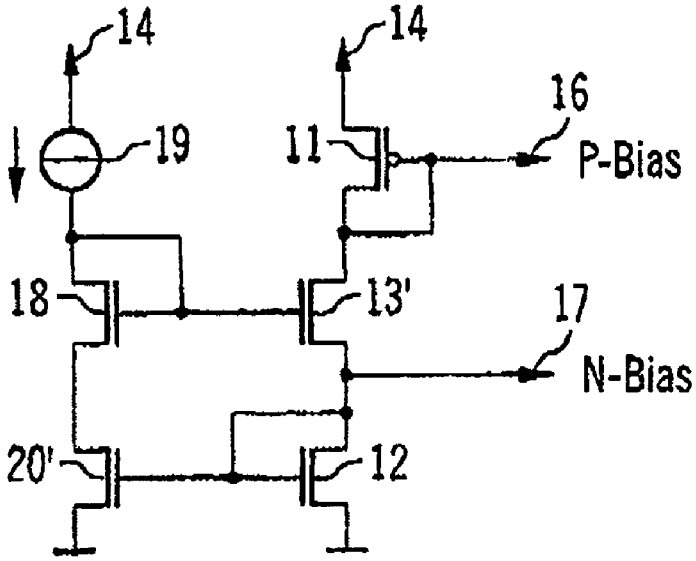
FIG. 5 shows a development of the circuit of FIG. 3 having a Wilson current mirror.

FIG. 5 shows another exemplary embodiment of a development of a current mirror arrangement in accordance with the proposed principle. The circuit of FIG. 5 largely corresponds to that of FIG. 4 in terms of the components used, their connection to one another and their advantageous method of operation and, in this respect, is not described again at this juncture.

Instead of the transistor 20 which is connected as a diode, the control connection of the transistor provided with reference symbol 20' in FIG. 5 is connected to the gate connection of the second transistor 12. As a result, the transistors 12, 20' together form a feedback current mirror which forms a Wilson current mirror together with the current mirror 18, 13' which operates in the forward direction. The Wilson current mirror 18, 13'; 12, 20' forms a closed control loop.

It also applies to the exemplary embodiment shown in FIG. 5 that the bias signals PBIAS, NBIAS which can be tapped off at the outputs 16, 17 match one another exactly.

In the context of the invention, all of the exemplary embodiments shown may also be implemented in a complementary design; this means that all transistors of the n conductivity type are replaced with p-MOS components and vice versa.

It goes without saying that the exemplary embodiments shown are not used to restrict the invention but merely for illustrative purposes.

LIST OF REFERENCE SYMBOLS

1 Reference potential connection
2 Transistor
3 Transistor
4 Current source
5 Supply potential connection
6 Transistor
7 Output
8 Output
9 Diode
10 Transistor
11 Transistor
12 Transistor
13 Controlled current source
13' Transistor
14 Supply potential connection
15 Reference potential connection
16 Output
17 Output
18 Diode
19 Reference current source
20' Transistor

The invention claimed is:

1. A current mirror circuit comprising:

a first transistor having a first conductivity type and being configured to output a first bias current;

a second transistor having a second conductivity type and being configured to output a second bias current, the second bias current being substantially identical to, and complementary to, the first bias current;

a current control device electrically connected between the first transistor and the second transistor;

a third transistor that is connected in a diode configuration, the third transistor being in a current path with a reference current source, the third transistor being electrically connected to the current control device; and a diode circuit in a current path with the third transistor and the reference current source;

wherein the first transistor, the current control device, and the second transistor are arranged in a common current path, the common current path being between a supply potential and a reference potential.

2. The current mirror circuit of claim 1, wherein the current control device is configured to operate with a floating potential.

3. The current mirror circuit of claim 1, wherein the first conductivity type and the second conductivity type are complementary.

4. The current mirror circuit of claim 1, wherein the first transistor is connected in a diode configuration, and the second transistor is connected in a diode configuration.

5. The current mirror circuit of claim 1, wherein the first transistor comprises a first control input and a first controlled path, the first controlled path being connected to the current control device, the first control input being connected to the first controlled path and to the current control device to form a first output path to output the first bias current; and wherein the second transistor comprises a second control input and a second controlled path, the second controlled path being connected to the current control device, the second control input being connected to the second controlled path and to the current control device to form a second output path to output the second bias current.

6. The current mirror circuit of claim 1, wherein the current control device comprises a transistor having a controlled path that is in a series circuit with controlled paths of the first and second transistors.

7. The current mirror circuit of claim 1, wherein the current control device and the third transistor form a current mirror.

8. The current mirror circuit of claim 1, further comprising:

an integrated circuit comprising the first transistor, the second transistor, the current control device, the third transistor, and the diode circuit.

9. The current mirror circuit of claim 8, wherein the integrated circuit comprises CMOS circuit.

10. The current mirror circuit of claim 1, wherein the diode circuit is connected to a reference potential.

11. The current mirror circuit of claim 1, wherein the first conductivity type comprises P-type and the second conductivity comprises N-type.

12. The current mirror circuit of claim 3, wherein the first transistor is connected in a diode configuration, and the second transistor is connected in a diode configuration.

13. The current mirror circuit of claim 3, wherein the first transistor comprises a first control input and a first controlled path, the first controlled path being connected to the current control device, the first control input being connected to the first controlled path and to the current control device to form a first output path to output the first bias current; and wherein the second transistor comprises a second control input and a second controlled path, the second controlled path being connected to the current control device, the second control input being connected to the second controlled path and to the current control device to form a second output path to output the second bias current.

14. The current mirror circuit of claim 13, wherein the current control device comprises a transistor having a controlled path that forms a series circuit with controlled paths of the first and second transistors.

15. The current mirror circuit of claim 14, wherein the current control device and the third transistor form a current mirror.

16. The current mirror circuit of claim 1, further comprising:

an integrated circuit comprising the first transistor, the second transistor, the current control device, the third transistor, and the diode circuit.

17. The current mirror circuit of claim 16, wherein the integrated circuit comprises CMOS circuit.

18. The current mirror circuit of claim 16, wherein the diode circuit is connected to a reference potential.

* * * * *